US007163085B1

(12) United States Patent
Bedi et al.

(10) Patent No.: US 7,163,085 B1
(45) Date of Patent: Jan. 16, 2007

(54) APPARATUS FOR DRAINING USED ENGINE OIL

(75) Inventors: Ram D. Bedi, Bloomfield Township, MI (US); George R. Blundy, Ferndale, MI (US); A. John Van der Griendt, Bloomfield Hills, MI (US)

(73) Assignee: K. J. Manufacturing Company, Wixom, MI (US)

( * ) Notice: Subject to any disclaimer, the term of this patent is extended or adjusted under 35 U.S.C. 154(b) by 314 days.

(21) Appl. No.: 10/408,587

(22) Filed: Apr. 7, 2003

Related U.S. Application Data

(60) Provisional application No. 60/419,351, filed on Oct. 18, 2002.

(51) Int. Cl.
*F16N 33/00* (2006.01)
*B65B 1/04* (2006.01)

(52) U.S. Cl. ..... 184/1.5

(58) Field of Classification Search ..... 184/1.5; 141/59, 65, 66, 98; 123/196 R, 196 S
See application file for complete search history.

(56) References Cited

U.S. PATENT DOCUMENTS 4,128,140 A * 12/1978 Riches ..... 184/1.5
4,951,784 A * 8/1990 Bedi ..... 184/1.5
5,062,398 A 11/1991 Bedi et al. ..... 123/196
5,145,033 A * 9/1992 Bedi et al. ..... 184/1.5
5,526,782 A * 6/1996 Bedi et al. ..... 123/196 A
5,566,781 A * 10/1996 Robert et al. ..... 184/1.5
6,073,666 A * 6/2000 Clark, II ..... 141/83
6,123,174 A * 9/2000 Elkin et al. ..... 184/1.5
6,145,622 A * 11/2000 Clark, II ..... 184/1.5
6,896,014 B1 * 5/2005 Bedi ..... 141/65
2004/0020720 A1 * 2/2004 Flynn ..... 184/1.5

FOREIGN PATENT DOCUMENTS

FR 2763359 A1 * 11/1998

* cited by examiner

*Primary Examiner*—Chong H. Kim
(74) *Attorney, Agent, or Firm*—Young Basile

(57) ABSTRACT

An apparatus for removing spent oil from an internal combustion engine and purging at least a portion of oil retained in an associated oil filter via air actuated valves in communication with a source of pressurized air. The apparatus has a waste receptacle and a venturi communicating with the waste receptacle for creating a vacuum therein. The air actuated valves include a timer to introduce the pressurized air to the oil filter for a predetermined amount of time to purge a portion of the spent oil in the oil filter into the internal lubrication distribution passage system.

10 Claims, 1 Drawing Sheet

APPARATUS FOR DRAINING USED ENGINE OIL

This application claims priority of Provisional Patent Application Ser. No. 60/419,351 filed Oct. 18, 2002.

BACKGROUND OF THE INVENTION

The present invention is directed to an apparatus and method for pneumatically draining the oil pan of an internal combustion engine.

The benefits of routine oil changes in a vehicle are well known. Routine oil changes have been shown to increase engine life and performance. With repeated prolonged use, motor oil builds up suspended particles, metallic and non-metallic, from the abrasive and/or adhesive wear of engine parts against one another and from products of incomplete combustion and improper air intake. The particles, in turn, cause abrasive wear of the engine bearings, piston rings and other moving parts and the reduction of the motor oil lubricity as various additives and lubricating components become depleted. This adversely affects engine performance and, if left unchanged, can destroy or cripple the engine performance.

To obtain satisfactory automotive engine performance, and minimize solid concentration levels in the motor oil, changing the motor oil in an automobile engine is a necessary, but an undesirable, dirty, and time-consuming task. As vehicles are designed, the oil pan serves the purpose of a reservoir for circulation of engine oil. To remove the contaminated oil, the drain plug, located in the lowermost region of the oil pan, is opened. The spent oil containing suspended particles is permitted to flow under gravity out of the pan into a suitable receptacle. After the spent oil is removed, usually through a separate opening in the engine valve cover.

The basic procedure has several drawbacks. It is time-consuming. The speed with which the oil drains through the drain valve is limited by the restrictive opening and gravity. In commercial settings, this can detain personnel and valuable, expensive resources such as hydraulic racks while waiting for the oil to drain. As previously indicated, the oil pan never drains completely. Oil containing suspended and sticky particles adhere to the walls of the pan to be mixed with the new oil added. This reduces the life of the oil filter which further reduces the life of the engine itself over extended use for a period of years.

The basic process is also messy. The drained oil must be moved, handled and, ultimately, disposed of in an appropriate manner. Drainage into open containers increases the opportunities for spillage and mishandling and exposure. Fresh oil introduced into the opening in the engine valve cover can be accidentally spilled in the engine compartment. The spilled oil can smoke and burn if spilled on the manifold and can attract dirt and grime, regardless.

Thus, it would be desirable to provide a process which accelerates removal of spent oil more completely from the crank case. It is also desirable to provide a process which permits the removal of adhering contaminants, degraded additives and oil products and replacement with fresh engine oil in an essentially clean container through a unified process. It is also desirable to provide a system which reduces the amount of spent oil handling as required in the conventional oil changes service station.

Finally, it is also desirable to provide a method and device which is economical to the consumer and supports and complies with the spirit and intent of current and proposed legislation regarding waste reduction, pollution abatement and conservation of natural resources.

SUMMARY OF THE INVENTION

The apparatus and method of the present invention consist of having an oil pan or reservoir to collect spent or used oil from the engine oil pan by creating a vacuum within an external tank by means of an air-driven venturi or other mechanical vacuum generating device which will accelerate the rate of withdrawing the spent used engine oil from the engine oil pan. During initial and simultaneous or with time lapse operation with the creation of the vacuum in the oil pan, pressurized air may be directed for a limited period of time to the dirty side of the engine oil filter so as to force spent oil within the filter and crankcase recesses/galleys to remove the used engine oil, which otherwise was not possible to be drained by gravity only. This also permits used engine oil removal from the engine without spillage of the oil.

After used engine oil has been removed from the engine oil pan and recesses of the crank case and the oil filter has been replaced with a fresh filter, oil is then communicated into the engine through the dirty side of the oil filter and filtered by the filter medium and then passed through the galley into the crank case.

It is therefore contemplated by this invention a three-step operation in which used oil is rapidly purged from the engine oil pan; the oil filter on the engine is purged of at least enough oil to permit its removal without the spillage of oil; the changing of the filter followed by the filling of the engine with fresh oil through the dirty side of the filter. This filtered oil lubricates the galley with fresh filtered oil to provide instant oil pressure and fills the crank case with fresh filtered engine oil and hence produces a better engine change.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
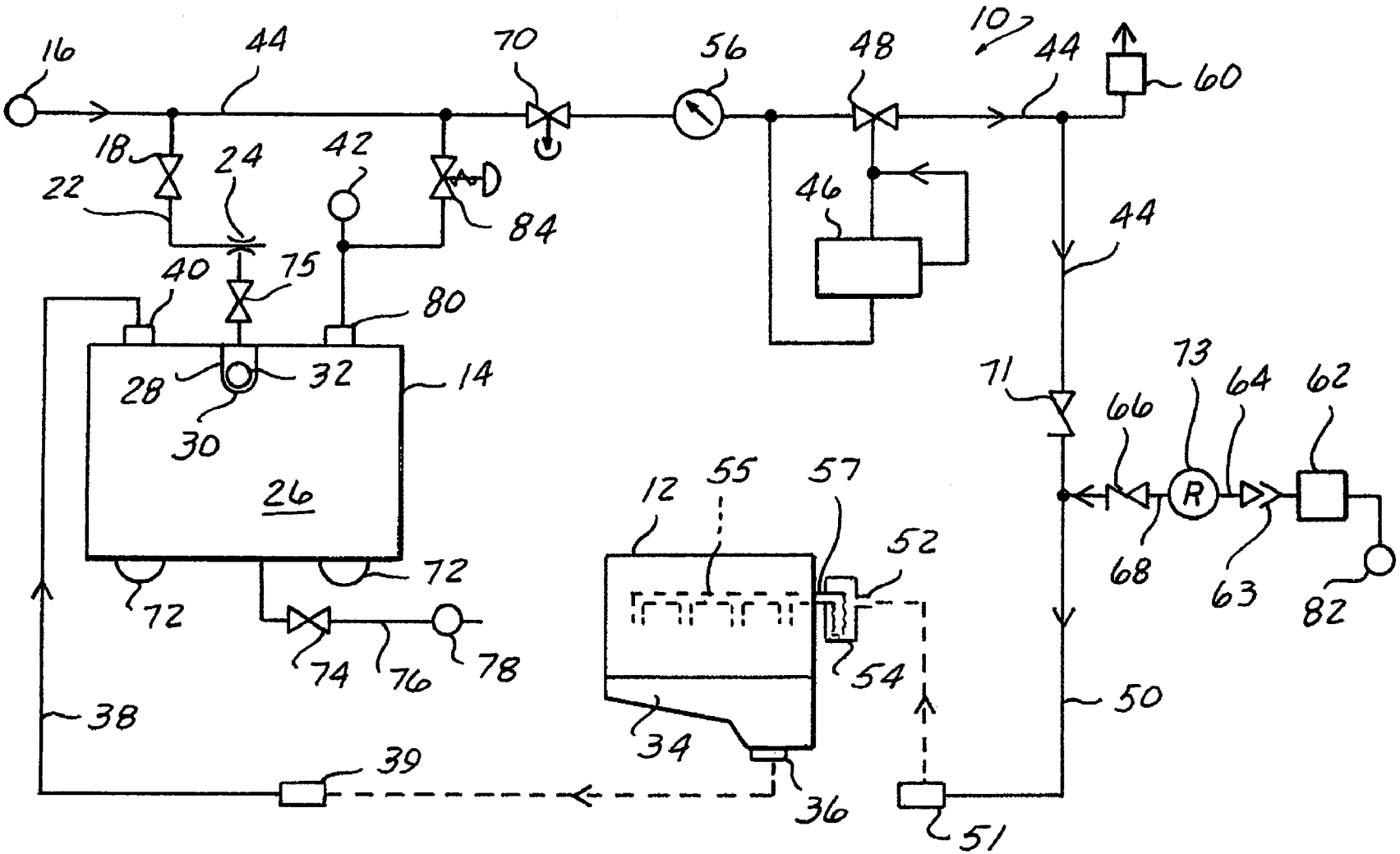
FIG. 1 is a schematic illustration of the present invention.

As shown in FIG. 1, the present invention includes an oil changing apparatus generally designated as 10, which is separable from an internal combustion engine generally designated as 12. The apparatus 10 may be a stationary unit or a unit capable of being moved from one location to another. As will be described in greater detail below, the present invention may include one or more adapters connected to the internal combustion engine to facilitate proper connection of the external oil removal apparatus to the lubrication system in the internal combustion engine. See U.S. Pat. No. 5,443,138, U.S. Pat. No. 5,588,502; and U.S. Pat. No. 5,743,352 which are incorporated by reference. One set of adapters may be any suitable device which provides access upstream of the oil filter unit. The one or more adapters may include an oil filter mounting adapter and a drain plug adapter. One or more of these adapters may be required to modify existing internal combustion engines 12 for use with the oil removal apparatus 10 of the present invention. However, it is envisioned that at some point in time manufacturers may modify the configuration of internal combustion engines to provide the appropriate coupling connections as required for the present invention as original equipment manufacturers optional, or standard equipment. Therefore, the present invention does not require the adapters disclosed in this application, but rather only requires a no-drip coupling connection capable of affecting removal of spent oil from the engine and associated engine parts, preferably in fluid communication with the lowermost portion of the oil pan reservoir and a second coupling connection in fluid communication with the internal oil lubrication distribution passage system, preferably between the oil pump and the oil filter element. It is also preferable that the coupling connections be provided with quick connect couplings as is conventional and known in the art and disclosed in U.S. Pat. No. 5,588,502.

Referring again to FIG. 1, the oil removal apparatus of the present invention includes a spent oil collection container 14. The oil removal apparatus 10 also includes a connection to a source of pressurized air or general shop air 16 at desirable regulated pressure. Connection to the source of pressurized air may be controlled by appropriate valves 18, 70 and 84 for opening and closing the communication of the pressurized air with the oil removal apparatus 10. The oil changing apparatus 10 includes a venturi 24 which is connected to the source of pressurized air 16 by way of a conduit 22. The venturi 24 communicates with the interior 26 of the spent oil collection container 14 by way of a vacuum shut-off valve 75. The tank 14 includes a valve 28 with a lower mesh or perforated surface 30 which allows air within the interior 26 of the container 14 to be drawn out by the action of the venturi 24 when pressurized air passes through the venturi 24. The perforated surface 30 of the valve 28 allows air to bypass the ball valve 32, until the level of the spent oil within the container 14 rises up and causes the ball 32 to engage the valve 28, thereby stopping further action of the venturi 24 on the interior of the container 14. The engine 12 has an oil pan or reservoir 34 provided with a quick disconnect no-drip nipple 36. The quick disconnect nipple 36 may be of the type disclosed in the aforementioned U.S. Pat. No. 5,588,502. The quick disconnect nipple 36 is connected to an appropriate quick connect coupling 39, and thereby connected to the waste oil receptacle 14 through coupling 40 by way of a flexible conduit 38. The connection 40 to the waste oil receptacle 14 is a swivel or non-swivel connector. Preferably, the conduit 38 is transparent/see through so that the operator can visibly confirm the flow of oil therethrough from the engine oil pan 34 to the interior 26 of the collection container 14. It can be seen that when an appropriate control system is utilized to activate the source of air pressure such as the turning on or off of the valve 18, which may be done manually or through other appropriately known on-off valves, pressurized air passes through conduit 22 and the venturi 24 to create a vacuum within the interior 26 of the collection container 14 and thereby forcing oil to be purged at a rapid rate from the engine oil pan 34 via conduit 38.

The spent oil collection container 14 optionally has a vacuum gauge or combined pressure/vacuum gauge 42 which provides the operator with an indication that the vacuum is still being created inside the interior 26 of the container 14. When the engine oil is purged from the oil pan 34 by way of the aforementioned process, the conduit 38 is connected to atmospheric pressure which results in the loss of vacuum in container 14. The source of pressurized air 16 may be terminated and the quick disconnect coupling 36 disconnected to separate the conduit 38 from the engine oil pan 34.

It should be noted that the conduit 22 is connected through a suitable "T" connection to a conduit 44 that communicates via an appropriate pneumatic timer 46, to control valve 48, and check valve 71 to a fresh oil supply/pressure line 50 that is, in turn, connected to the inlet side 52 of an oil filter 54. The connection of the fresh oil supply/pressure line 50 to the inlet side 52 of the oil filter is preferably with an appropriate quick connect coupling 51. The oil filter 54 and the aforementioned inlet connection 52 may be of the type illustrated in any of the aforementioned patents which have been incorporated in here by reference. The inlet 52 is on the dirty side of the filter 54. The clean side of the filter 54 is connected by way of an appropriate conduit 57 to the engine interior and internal oil lubrication distribution passage system 55 in a well-known fashion as again described in the aforementioned patents. In one embodiment, when the source of air pressure 16 is communicated to a conduit 22 by way of the manually operable on/off valve 18, pressurized fluid is simultaneously communicated through conduit 44 to the pneumatic timer 46 which is in an "on" position so that pressurized air flows through the control valve 48 and conduits 44 and 50 to an oil filter 54 for a limited controlled period of time. The amount of time will depend upon the size of the filter and it can be between five and three hundred seconds. It should be of sufficient time and duration so as to purge a selected amount of oil from the oil filter 54, through conduit 57 into the oil galleys and finally into the oil pan 34. Depending upon the user's desires, it can be just enough to lower the oil in the oil filter an inch or completely purged, as desired. The primary purpose of directing air through conduit 50 is to purge the filter 54 of a selected amount of oil and to permit the oil filter 54 to be removed without spilling any spent oil during the oil filter removal process.

A pressure regulator 56 is preferably disposed in conduit 44 to regulate the air pressure going to the oil filter 54 as well as to the timer valve 46. Therefore, the pressure regulator 56 is positioned preferably upstream from the timer valve 46. In the illustrated embodiment, the air pressure is regulated to 30 psi although other environments may require other air pressures.

As an alternative, and a preferred embodiment, a three-way toggle valve 70 may be disposed in conduit 44 upstream of the pressure regulator 56 and the timer valve 46. The three-way valve 70 allows the operator to select whether he wants to simultaneously purge the oil filter 54 while the engine oil reservoir 34 is being purged. The three-way toggle valve 70 can be manually operable. When the three-way toggle valve 70 is in the "off" position, the air pressure in conduit 44 is diverted to atmosphere and the timer valve 46 is set in the "off" position. When the three-way toggle valve 70 is activated, the timer 46 is set to the "on" position and the toggle valve 70 allows the pressurized air to the regulator 56 and the timer valve 46 to purge a predetermined amount of spent oil from the oil filter 54 when the three-way toggle valve 70 is in the "off" position, the air pressure flows to the venturi 24 to purge the engine oil reservoir without simultaneously communicating the air pressure to the oil filter 54 until the three-way toggle valve 70 is manually turned on.

A pressure indicator gauge 60 (or similar device) communicated to the conduit 44 is activated when the line is pressurized so that the operator may see that purging air is being directed to the filter 54. When the timer valve 46 reaches its predetermined setting and deactivates, it will stop the flow of pressurized air through the conduit 44 at which time the pressurized indicator 60 will indicate there is no pressure in the line and that the air purging operation is being completed. Since pressurized air is simultaneously being sent to the venturi 24, the operator will need some type of visual indicator, such as the gauge 60 to indicate that the purging operation is completed. Now the operator can spin off the spent oil filter and install a new empty oil filter without spilling spent oil from the old filter.

Once the flow of pressurized purging air has been terminated, the operator can then open the oil filter 54 and remove the spent filter medium therefrom, without spilling oil, and replace the spent filter medium with a new filter medium without charging any fresh oil in the new filter. After the conduit 38 has been disconnected from the oil pan 34, the on/off manually operable valve 18 is closed, either manually or automatically, isolating the venturi and the conduit 44 from communication with the source of pressure 16. At the same time, a new oil supply 62 can be provided to the engine. The new oil supply source consists of a reservoir or oil container 62 which is connected via a quick disconnect coupling 63 by way of a conduit 64 to a regulator 73 and a check valve 66 in conduit 68 and the conduit 50. It can thus be seen that when a pump 82 is actuated, oil from the reservoir 62 will be directed through conduits 64 and 68 to conduit 50 and enter the filter 54 via the dirty side entry of the newly installed filter inlet 52. The oil will pass through the filter medium and be communicated to the engine in the conventional manner via conduit 57. Check valve 71 prevents oil under pressure in conduit 50 from being directed back to the timer 46 and into the air supply conduit 44 or to the venturi 24. Check valve 66 serves the purpose of preventing pressurized air from being directed to the oil container 62 during the air purging process hereinbefore described. As an alternative, the valve represented at 66 may be a control valve having a manually operable dial to preset the desired amount of oil to be communicated to the engine 12. Preferably, an oil pressure regulator 73 is disposed in conduit 68 to maintain an adequate pressure for the oil into the oil filter 54. In the illustrated embodiment, the oil pressure can be up to 65 psi, although other embodiments may require other oil pressures.

If the container 14 becomes full to the point where the level of spent oil rises up to the valve 28 so as to cause check valve ball 32 to engage the valve opening, it will close the valve 28 and prevent further communication from the venturi 24. The vacuum in the interior 26 will drop off and the gauge 42 will so indicate to the operator that it is time to turn off the source of pressurized air 16 to the venturi 24 and to purge the collection container 14. Purging of the container 14 can be done in a variety of ways. Preferably the conduit 22 is disconnected from the venturi 24 and the flexible conduit 38 is disconnected from the oil pan 34. The unit may be on appropriate wheels 72 and the oil collection container 14 may be moved to a new desirable location. There is a shutoff valve 74 provided at the lower end of the container 14, which may be connected to a suitable drain line 76, which in turn may be connected to a larger used oil storage container, not shown.

Optionally, a suction pump 78 may be utilized and connected to the drain line 76 to force the oil to flow at a greater rate from the interior 26 of the container 14. Alternately, a source of pressurized air 16 may be connected via an on/off valve 84 to an inlet 80 at the top portion of the collection container 14. It can be seen that when the shutoff valve 84 is open and pressurized air is forced into the interior 26, the spent oil within the collection container 14 will be forced at a greater rate of flow through the shutoff valve 74 and drain line 76 for appropriate disposal. When this arrangement is used, the pump 78 would not be utilized. Valves 75 must be closed during this purging operation.

While the invention has been described in connection with what is presently considered to be the most practical and preferred embodiment, it is understood that the invention is not limited to the disclosed embodiment, but on the contrary, it is intended to cover various modifications and equivalent arrangements included within the spirit and scope of the claims, which claims should be accorded the broadest possible interpretation so as to encompass all such modifications and equivalent instructions as is permitted under the law. Such modifications can include the use mechanically operated pumps, electrically operated sensors, and mechanically driven vacuum generating pumps in lieu of the venturi 24. One of the advantages of the present system, though, is that the entire system operates with either an air pressure and/or a hand-operated pump such as the pump 16 that eliminates the need of any electrical devices.

What is claimed is:

1. A pneumatically driven apparatus for draining the oil of an internal combustion engine having all internal oil lubrication distribution passage system with an oil filter and an oil reservoir, said oil filter having a dirty portion and a clean portion therein, said apparatus comprising:

means for purging spent oil from the oil filter;

means for removing spent oil from said engine oil reservoir;

means for creating a vacuum within the engine oil reservoir for accelerating the rate of withdrawing spent oil from the engine oil reservoir;

means for introducing oil into the engine oil reservoir through the oil filter and the internal lubrication distribution passage system;

a source of pressurized air;

a first fluid passage interconnecting the source of pressurized air with the internal oil lubrication distribution passage system at a position upstream of the oil filter;

a second fluid passage interconnecting the source of pressurized air with a waste oil reservoir, wherein the means for creating a vacuum within the oil pan is positioned in the second fluid passage means; and an array controlling communication between the source of pressurized air and the internal oil lubrication distribution passage system via the oil filter, the control array regulating passage of pressurized air through the first fluid passage.

2. The apparatus of claim 1, wherein the means for creating a vacuum within the oil reservoir includes a venturi valve positioned in the second fluid passage means.

3. The apparatus of claim 2, further comprising a means to optionally opening and closing the flow of pressurized air to the venturi valve.

4. A pneumatically driven apparatus for draining the oil of an internal combustion engine having an internal oil lubrication distribution passage system with an oil filter and an oil reservoir, said oil filter having a dirty portion and a clean portion therein, said apparatus comprising:

means for purging spent oil from the oil filter;

means for removing spent oil from said engine oil reservoir;

means for creating a vacuum within the engine oil reservoir for accelerating the rate of withdrawing spent oil from the engine oil reservoir;

means for introducing oil into the engine oil reservoir through the oil filter and the internal lubrication distribution passage system;

a source of pressurized air;

a first fluid passage interconnecting the source of pressed air with the internal oil lubrication distribution passage system at a position upstream of the oil filter; and valve means for controlling communication of the source of pressurized air with the internal lubrication distribution passage system via the oil filter;

a second fluid passage interconnecting the source of pressurized air with a waste oil reservoir, wherein the means for creating a vacuum within the oil pan is positioned in the second fluid passage means; and a third fluid passage means interconnecting the source of pressurized air with the waste oil reservoir.

5. The apparatus of claim 4, wherein the third fluid passage means has a manually operable valve therein for selectively permitting the flow of pressurized air to the waste oil reservoir.

6. The apparatus of claim 5 further comprising means for selectively purging oil from the oil filter while simultaneously removing spent oil from the engine oil reservoir.

7. A pneumatically driven apparatus for draining the oil of an internal combustion engine having an internal oil lubrication distribution passage system with an oil filter and an oil reservoir, said oil filter having a dirty portion and a clean portion therein, said apparatus comprising:

means for purging spent oil from the oil filter;

means for removing spent oil from said engine oil reservoir;

means for creating a vacuum within the engine oil reservoir for accelerating the rate of withdrawing spent oil from the engine oil reservoir;

means for introducing oil into the engine oil reservoir through the oil filter and the internal distribution passage system;

a source of pressurized air;

a first fluid passage interconnect the source of pressurized air with the internal oil lubrication distribution passage system at a position upstream of the oil filter;

valve means for controlling communication of the source of pressurized air with the internal oil lubrication distribution passage system via the oil filter, wherein the valve means has means for limiting the period of time of communicating the source of pressurized air with the internal oil lubrication distribution passage system via the oil filter, the communication limiting means in communication with the valve means, the limiting means including a normally closed valve associated with a timer, wherein after the period of time has elapsed, the normally closed valve is opened for stopping the communication of the pressurized air with the internal oil lubrication distribution passage system via the oil filter; and a three-way valve in the first fluid passage positioned upstream of the timer for resetting the time after the period of time has elapsed.

8. The apparatus of claim 1, further comprising spent oil fluid passage in fluid communication from the interior of the waste oil reservoir to the interior of the oil reservoir of the internal combustion engine.

9. The apparatus of claim 8, further comprising means for signaling when the waste oil reservoir is full of waste oil.

10. The apparatus of claim 1 further comprising a drain valve at a lower portion of the waste oil reservoir for draining the waste oil out of the waste oil reservoir.

* * * * *